United States Patent [19]

Kilborne

[11] 3,982,719

[45] Sept. 28, 1976

[54] PICTURE HANGER

[76] Inventor: George B. Kilborne, 216 Bermuda Lane, Palm Beach, Fla. 33480

[22] Filed: Nov. 28, 1975

[21] Appl. No.: 636,344

[52] U.S. Cl. ..... 248/489; 248/301; 248/493

[51] Int. Cl.[2] ..... A47G 1/16

[58] Field of Search ..... 248/489, 493, 496, 498, 248/497, 470, 301

[56] References Cited

UNITED STATES PATENTS

| | | | |
|---|---|---|---|
| 287,113 | 10/1883 | Ellithorp | 248/301 |
| 861,142 | 7/1907 | Rynek | 248/493 |
| 894,197 | 7/1908 | Fleming | 248/498 |
| 2,317,368 | 4/1943 | Frey | 248/493 |
| 2,330,373 | 9/1943 | Moore | 248/489 |
| 3,685,781 | 8/1972 | Webster | 248/497 |

FOREIGN PATENTS OR APPLICATIONS

| | | | |
|---|---|---|---|
| 366,178 | 3/1920 | Germany | 248/498 |
| 44,590 | 2/1916 | Sweden | 248/489 |
| 8,173 | 1903 | United Kingdom | 248/493 |

*Primary Examiner*—Robert A. Hafer
*Attorney, Agent, or Firm*—Reising, Ethington, Barnard, Perry and Brooks

[57] ABSTRACT

A hanger for pictures or the like is disclosed as having an upper suspension point and a pair of lower wire receiving hooks for receiving a laterally extending wire on a picture to be hung. The hanger includes an aperture at the upper suspension point for receiving a nail or the like which suspends the hanger on a wall. The wire receiving hooks are spaced laterally on opposite sides of the aperture the same lateral distance. Pivoting of the hanger during its suspension levels the hooks with each other. The lateral spacing of the hooks supports the picture wire so as to prevent pivoting of the picture about the hanger. The hanger preferably has an inverted Y shape whose upper leg defines the suspension aperture and whose lower two legs define the wire receiving hooks. The hanger is made from a metallic body and is stamped to form the hooks and reinforcing ribs in each leg as well as projections that engage the wall to prevent pivoting of the hanger about its suspension point. The hook of each lower leg also is stamped to form ramps that space the picture wire outwardly from the wall so that the weight of the picture maintains the engagement between the stamped projections and the wall. Notches in the hooks at the outer ends of the ramps receive the picture wire and include edges that bite into the wire to prevent sliding thereof through the hooks and consequent movement of the picture.

3 Claims, 4 Drawing Figures

PICTURE HANGER

BACKGROUND OF THE INVENTION

1. Field of the Invention

The present invention relates to a hanger for pictures or the like.

2. Description of the Prior Art

It is well known to utilize hangers for supporting pictures or the like, i.e. mirrors, decorative plaques, and framed diplomas, certificates, momentos, etc. One type of picture hanger supports the picture at its lower edge, see U.S. Pat. Nos. 642,997 and 3,788,589. Another type of picture hanger utilizes a wire receiving hook that receives a laterally extending wire on the picture to be hung. The picture can pivot about this type of hanger since its suspension by the wire on the hook is essentially a pivotal support. U.S. Pat. Nos. 371,665 and 3,294,356 disclose picture hangers that are supported on a wall by a pair of laterally spaced supports and include a pair of laterally spaced hooks for receiving a wire on a picture to be hung. The suspension of these hangers by a pair of laterally spaced supports requires that the hanger be leveled during its suspension so that the pair of hooks will be located at the same elevation as each other. In fact, the picture hanger of U.S. Pat. No. 3,294,356 supports a pendulum that indicates whether or not the hanger is level during its suspension. U.S. Pat. Nos. 2,286,539 and 3,343,773 and Swiss Patentschrift 255,358 disclose other suspension devices.

The laterally extending wire on a picture to be hung is usually and preferably of a metallic composition, but string and twine, etc., can also function for this purpose. Also, nails are usually utilized to suspend picture hangers on a wall, but screws and projecting pegs from the wall, etc., can also be utilized.

SUMMARY OF THE INVENTION

An object of the present invention is to provide an improved hanger for pictures or the like wherein the hanger has a body having a single upper suspension point about which the hanger pivots to level a pair of laterally spaced wire receiving hooks that are located below the suspension point on opposite sides thereof the same lateral distance.

Another object of the invention is to provide a hanger for pictures or the like wherein the hanger includes a metallic body of a stamped construction having an upper leg and a pair of lower legs arranged in an inverted Y shape, with the upper leg including an aperture that provides a single suspension point for the hanger, and with the lower legs including laterally spaced wire receiving hooks located on opposite sides of the suspension point the same lateral distance so as to be leveled with each other during pivoting of the hanger about the suspension point.

In carrying out the above object, and other objects of the invention, a preferred embodiment of the hanger includes a metallic body of a stamped construction that has an inverted Y shape defined by an upper leg and a pair of lower legs. The upper leg defines an aperture for receiving a nail or the like, i.e. a screw or a peg projecting from a wall on which the hanger is to be suspended. The lower legs each include a wire receiving hook for receiving a laterally extending wire on a picture to be hung. These hooks are laterally spaced on opposite sides of the upper aperture the same lateral distance and are leveled with each other by pivoting of the hanger during its suspension under the influence of the force of gravity. Each leg of the hanger body includes a reinforcing rib as well as a projection on its rear side that faces the wall on which the hanger is suspended. The projections of the legs engage the wall due to the weight of the picture suspended thereby and thereby prevent pivoting of the hanger about its upper suspension point. The wire receiving hooks of the two lower legs include inclined ramps that normally position the picture wire away from the wall so as to increase the forces engaging the leg projections with the wall in a manner that decreases the likelihood of having the hanger pivot. The wire receiving hooks also include notches at the outer ends of the ramp that receive the picture wire and have edges that bite into the wire to prevent sliding of the wire through the hooks and consequent movement of the picture.

The objects, features and advantages of the present invention are readily apparent from the following detailed description of the preferred embodiment taken in connection with the accompanying drawings.

DETAILED DESCRIPTION OF THE PREFERRED EMBODIMENT

Figure 1:
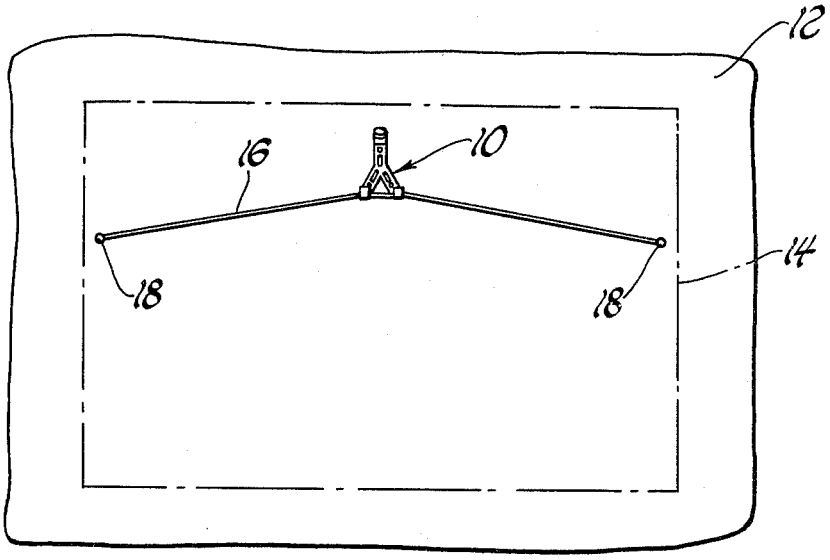
FIG. 1 is a front view showing a picture hanger suspended on a wall and supporting a picture indicated by phantom lines.

With reference to FIG. 1, a hanger for pictures or the like that is constructed according to the present invention is indicated by numeral 10 and is shown suspended on a vertical wall 12. A picture or the like 14 includes a laterally extending wire 16 whose ends are secured by attachments 18 to the edges of the picture and whose intermediate portion is supported by the hanger so that the picture is mounted on the wall 12.

Figure 2:
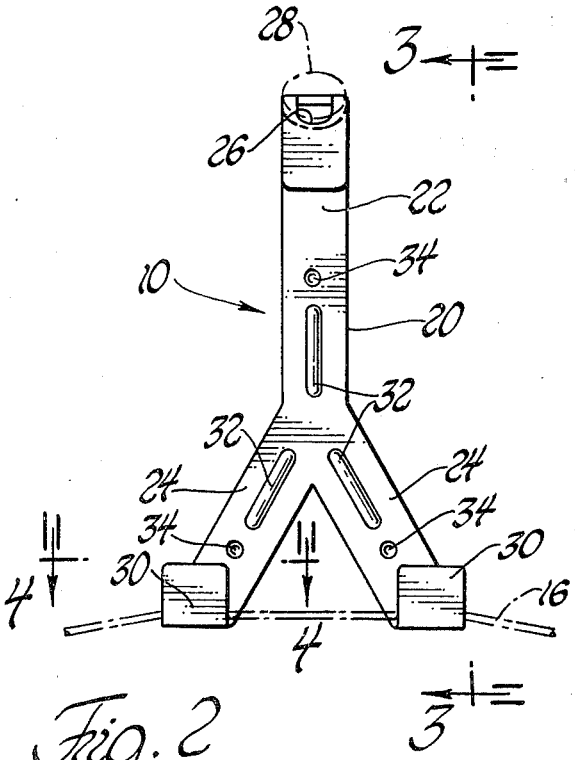
FIG. 2 is an enlarged front view of the picture hanger shown in FIG. 1.
Figure 3:
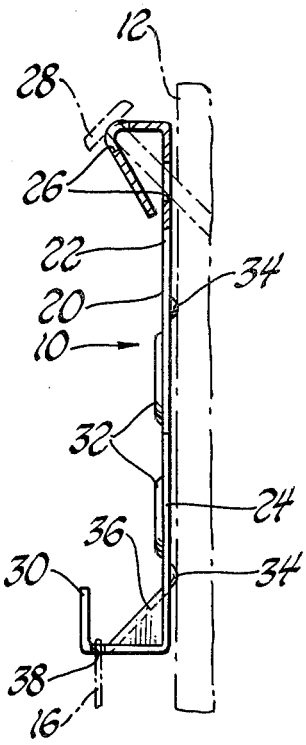
FIG. 3 is a side view of the picture hanger taken along line 3—3 of FIG. 2.
Figure 4:
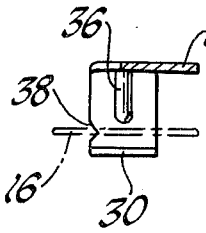
FIG. 4 is a top plan view taken in section along line 4—4 of FIG. 2 and shows a wire receiving hook of the hanger.

With additional reference to FIGS. 2 and 3, the hanger 10 includes a metallic body 20 that is stamped from suitable planar stock. The body of the hanger has an inverted Y shape defined by an upper leg 22 and a pair of lower legs 24. An upper end of upper leg 22 is curved over itself and defines aligned apertures 26 that receive a nail 28 that is driven into the wall 12. Preferably, this nail is driven at an angle of approximately 45° as shown. A screw may also be utilized to suspend the hanger as well as a peg projecting from the wall. The lower legs 24 each include a lower wire receiving hook 30 receiving the picture wire 16. These hooks 30 are spaced on opposite lateral sides of the apertures 26 the same lateral distance and are leveled with each other during suspension of the hanger by pivoting thereof under the influence of the force of gravity. The lateral spacing of the hooks prevents the picture wire 16 from permitting pivoting of the picture about the hanger.

Each of the legs 22 and 24 includes an elongated reinforcing rib 32 that is of a stamped construction projecting outwardly in a forward direction. Each of these legs 22 and 24 also includes a dimple-like projection 34 that projects from its rear side which faces the wall 12. The projections 34 are maintained in engagement with the wall 12 due to the weight of the picture supported by the hanger. This engagement is in a three point arrangement that accommodates for irregularities in the wall surface and prevents pivoting of the hanger about the upper suspension point provided by the nail 28 received within the apertures 26.

Each lower hook 30 is stamped to include an inclined ramp 36 sloping away from the wall on which the hanger is suspended. The ramps 36 cause the picture wire 16 to be maintained in a spaced relationship outwardly from the wall. This spaced relationship maintains the force of engagement between the leg projections 34 and the wall and thereby decreases the likelihood of the hanger pivoting about its upper suspension point. The hooks 30 also include notches 38 located at the outer lower ends of the ramps 36. The picture wire 16 is received within the notches 38 and the upper extremity of these notches include relatively sharp edges that bite into the wire to prevent sliding of the wire through the hooks. This decreases any possibility of the picture moving due to sliding of the wire through the hanger.

Also, while the hook legs 24 have been disclosed as being spaced from each other by open space, the body of the hanger could include a portion which fills in this area. Likewise, the picture hanger can be made from other materials than the preferred metal construction shown.

While a preferred embodiment has been described in detail, those skilled in the art will recognize various alternative embodiments and constructions for practicing the present invention as defined by the following claims.

What is claimed is:

1. A hanger for pictures or the like, the hanger comprising: a metallic body of a stamped construction that includes an upper leg and a pair of lower legs arranged in an inverted Y shape; the upper leg including an aperture for receiving a nail that is adaptable to suspend the hanger on a wall, the force of gravity pivotally positioning the hanger about the nail in a downwardly depending orientation; the lower legs including a pair of laterally spaced wire receiving hooks located on opposite sides of the aperture the same lateral distance; the wire receiving hooks being leveled with each other by gravity during suspension of the hanger and the hooks being adaptable to receive a laterally extending wire or the like on a picture to be hung so that laterally spaced support of the wire prevents pivoting of the picture about the hanger; each leg including a projection that extends rearwardly to engage the wall; each hook including an inclined ramp that extends outwardly and downwardly from the associated leg so that the picture wire is positioned outwardly from the wall to bias the leg projections against the wall; and each hook including a notch that opens horizontally away from the other hook at the outer end of the adjacent inclined ramp so as to bite into the wire.

2. A hanger as in claim 1 wherein the inclined ramps of the hooks are generally straight and the notches of the hooks are of V-shapes when viewed in a vertical direction.

3. A hanger as in claim 1 wherein each leg includes a reinforcing rib that projects away from the wall in a direction opposite to the leg projections which engage the wall.

* * * * *